US006585781B1

(12) United States Patent
Roseen

(10) Patent No.: US 6,585,781 B1
(45) Date of Patent: Jul. 1, 2003

(54) LAUNDRY WASHING MACHINE WITH STEAM DRYING

(75) Inventor: Rutger Roseen, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 81 days.

(21) Appl. No.: 09/807,051

(22) PCT Filed: Aug. 7, 2000

(86) PCT No.: PCT/SE00/01553

§ 371 (c)(1),
(2), (4) Date: Apr. 6, 2001

(87) PCT Pub. No.: WO01/11134

PCT Pub. Date: Feb. 15, 2001

(30) Foreign Application Priority Data

Aug. 9, 1999 (SE) ..... 9902862

(51) Int. Cl.[7] ..... D06F 25/00; D06F 58/24

(52) U.S. Cl. ..... 8/149.1; 8/149.3; 8/158; 68/5 C; 68/18 C; 68/19.2; 68/20

(58) Field of Search ..... 8/149.1, 149.3, 8/158; 68/5 C, 18 C, 19.2, 20; 34/321, 327, 425, 449, 75, 77

(56) References Cited

U.S. PATENT DOCUMENTS 4,447,965 A 5/1984 Bray ..... 34/77 X
4,527,343 A * 7/1985 Danneberg ..... 68/5 C X
5,219,371 A * 6/1993 Shim et al. ..... 68/5 C X
6,161,306 A 12/2000 Clodic ..... 34/321

FOREIGN PATENT DOCUMENTS

| | | |
|---|---|---|
| EP | 0 737 772 A2 | 4/1996 |
| WO | WO 89/04392 | 5/1989 |
| WO | WO 94/05846 | 3/1994 |
| WO | WO 00/26595 | 5/2000 |

* cited by examiner

*Primary Examiner*—Philip R. Coe
(74) *Attorney, Agent, or Firm*—Pearne & Gordon LLP

(57) ABSTRACT

A combined machine for washing and drying textiles comprises a wash liquor tub, which contains an inner drum rotatably provided and supporting the textiles during the washing and drying processes and having a volume adapted to requirements relating to the wash process, water supply means for supplying water into the tub, means for the supply of detergents, water draining means for draining washing and rinsing liquid from the tub, and means for driving a moisture absorbing gaseous medium in a closed loop past the textiles in the inner drum. The moisture absorbing gaseous medium, which consists of dry superheated steam, and compressor means are provided to compress part of the steam diverted from the closed loop and lead it to heat exchanger means provided to condense the compressed steam and return the heat released during the condensing process to the steam in the closed loop.

10 Claims, 1 Drawing Sheet

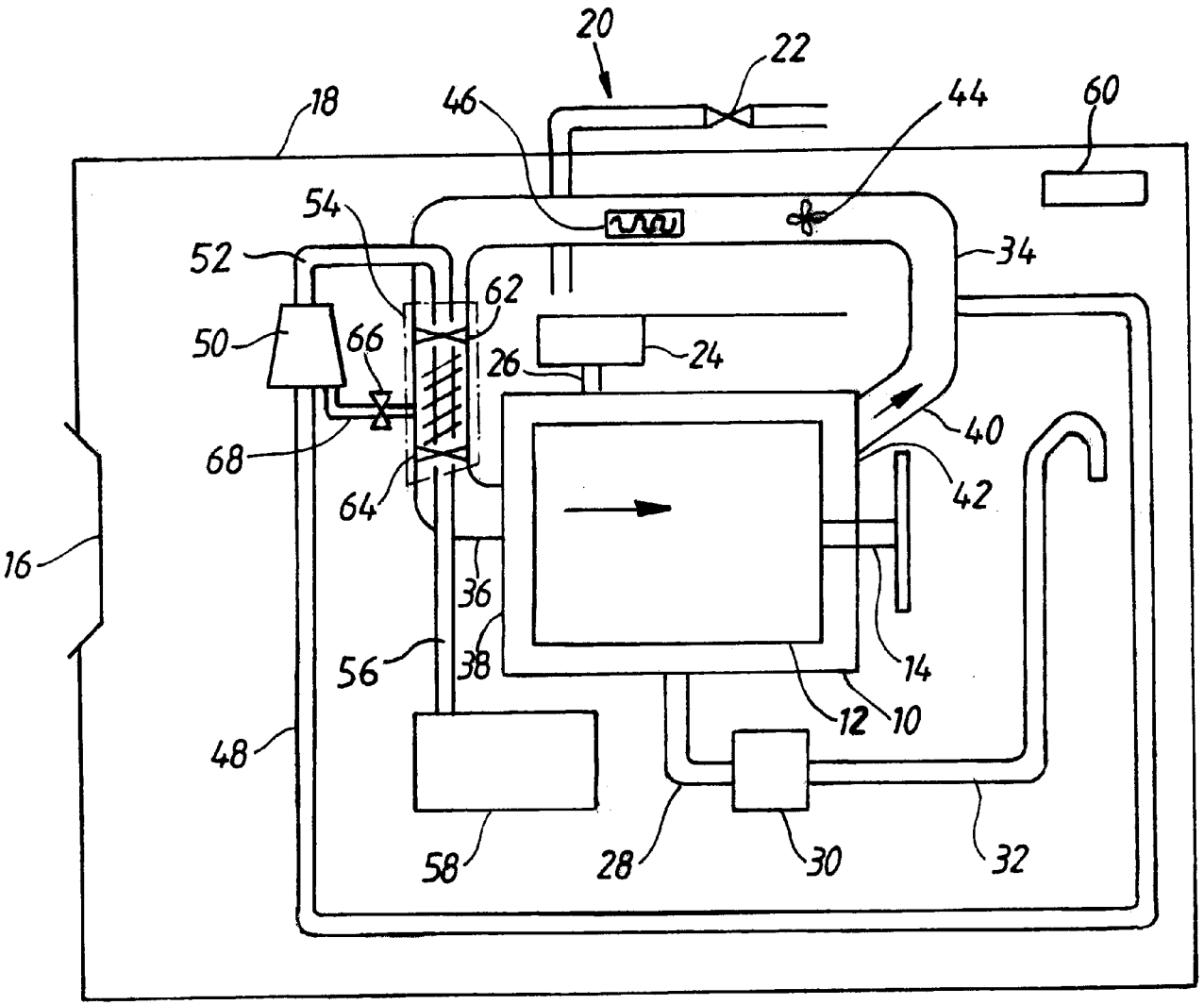
60
44
34
40
42
14
10
12
32
22
30
24
20
28
46
26
62
36
38
58
54
66
64
56
18
52
50
68
48
16

LAUNDRY WASHING MACHINE WITH STEAM DRYING

This application claims the benefit of International Application Number PCT/SE00/01553, which was published in English.

The present invention refers to a combined domestic machine for washing and drying textiles, comprising a wash liquor tub which contains an inner drum rotatably provided and supporting the textiles during the washing and drying processes and having a volume adapted to requirements relating to the wash process, water supply means for supplying water into the tub, water draining means for draining washing and rinsing liquid from the tub, means for driving a moisture absorbing gaseous medium through the inner drum, and program control means for controlling the washing and drying processes. The invention also relates to a method for washing and drying textiles in a treatment chamber, wherein the textiles are first treated in a conventional water washing process, dewatered by means of spin-drying and then dried by means of superheated steam circulated in a closed loop past the textiles.

Combined machines for washing and drying textiles are known, e.g. from patent publication GB-A-2181220. Such machines have been provided as an option for a completely automatized washing and drying process for articles of clothing. Another object is to reduce the space required in order to provide for both washing and drying of articles of clothing in a room.

Domestic laundry washing machines of today have been optimized as to the functions of washing and spin-drying and have a given drum volume such that the machine can handle wash loads of 4–5 kilos of dry laundry. Drying of the same wash load by means of tumbling in a drying drum calls for essentially double the drum volume. Accordingly, the traditional solution has been to provide a washing machine and a tumble drier each optimized for its respective task.

For the purpose of reducing space solutions have also been offered where the tumble drier has been mounted on top of the washing machine in a secure way. Thereby, to some extent the problem of space has been solved, however, the automated washing and drying process is still waiting for its solution.

When drying garments in a washing drum with circulating hot air the drum volume must have a fair size in order for an even drying to be achieved and the garments not to get creased. As a result, if the full capacity of the machine in the washing process is used the subsequent drying has to be carried out in two batches, each comprising half the wash load. Accordingly, there is a desire for rendering the drying process more effective so that the whole wash load can be tumbled in one go without the process taking a disproportionately long time and without the laundry garments getting creased in an unallowable way.

It has now been found that replacing the hot air with superheated steam causes the heat transfer to the fibres of the garments to take place more efficiently at the same time as the tendency of creasing is reduced.

Patent publication EP-A-101074 discloses such way of using superheated steam in drying laundry in a tumble drier or the like. The drying process comprises two phases where in a first phase as fast as possible the laundry is heated to a temperature of 99–100° C. The heating is achieved by the supply of wet steam. In a subsequent second phase the steam is led through a heat exchanger to be superheated and is then circulated past the laundry to remove the moisture remaining in the laundry.

The publication EP-A-395685 also describes the use of superheated steam for drying of laundry.

In the publication EP-A-101074, referred to above, a heat exchanger is used for heating the steam to become superheated. In patent publication FR 2496781 a drying apparatus for products such as corn, fruit, wood and the like is described, wherein steam emitted from the products during the drying process is led to a compressor to be compressed and then led to a condenser which returns heat to the products for the evaporation of additional moisture. The products are heated by means of superheated steam circulated by means of a fan past the products and heated by the condenser. By use of the steam compressing system a very high thermal efficiency is achieved. As a matter of fact: 3–4 times as much water is extracted per unit of supplied energy as compared to previous drying systems.

Based on the prior art technique described it is an object of the invention, in particular in combined domestic machines for washing and drying of laundry, to further improve the efficiency of the drying process described in the publication EP-A-101074 by application of the technique described in the publication FR 2496781. The object is achieved in a combined machine for washing and drying textiles, where dry superheated steam is circulated in a closed loop past the textiles, and compressor means is provided to compress part of the steam and lead it to a heat exchanger means. The heat exchanger means condenses the compressed steam and returns the heat released during the condensing process to the steam in the closed loop. The objective is also achieved by a method for washing and drying textiles in a treatment chamber, where the textiles are first treated in a water washing process and then dried by dry superheated steam circulated in a closed loop past the textiles. Part of the steam in the circulation loop is diverted and heated by being compressed to a temperature exceeding 100° C. and then lead to a heat exchanger, where the heat released during the condensing process is transferred to the steam in the circulation loop.

The objective is also achieved by a method for washing and drying textiles in a treatment chamber where the textiles are first treated in a water washing process and then dried by dry superheated steam circulated in a closed loop past the textiles. Part of steam in the circulation loop is diverted and heated by being compressed to a temperature exceeding 100° C. and then led to a heat exchanger, where heat released during the condensing process is transferred to the steam in the circulation loop.

In one embodiment of the invention, in which dry superheated steam is used as the drying medium during the drying process and, further, compressor means are provided for compressing the steam discharged from the machine and lead it to condenser means provided to return to the process heat released during the condensing process, the advantage is obtained that the dehumidification of the textile garments takes place in a more efficient way so that the drying time can be considerably shortened. Due to the fact that the steam transfers heat to the fibres of the textile garments in a more efficient and careful way, as a result also the tendency of creasing is reduced and the relatively small volume of the washing drum of the machine can be accepted. In addition, the full wash load can be dried in one and the same drying process instead of in two batches as up to now. Bythe invention possibilities are opened up of drying wool garments which has not been considered possible in the past due to the great risk of crease. In using steam as the drying medium this risk is considerably reduced and as the drying process only requires moderate drying medium flows and, in addition, the steam well penetrates the fibres of the wool garments without any stirring of the garments by tumbling the drying process becomes very careful.

The invention will now be described more in detail in connection with an embodiment and with reference to the accompanying drawing which schematically shows the assembly of a combined domestic machine for washing and drying textiles according to the invention.

The machine shown in the drawing is basically built as a domestic laundry washing machine with a capacity of 4–5 kilos of dry laundry. Accordingly, the machine comprises an outer drum 10 serving as a container for washing and rinsing liquid and further enclosing an inner drum 12 journalled at one end and for this purpose provided with a shaft 14. The opposite end of the inner drum is open serving as a loading opening for laundry articles which via a front door 16, provided in an outer cabinet 18, can be inserted into the inner drum 12 and removed therefrom. In the usual way, an opening in the outer cabinet 18, closable by the front door 16, is connected to a corresponding opening provided in the outer drum 10, in line with the loading opening in the inner drum, by means of a bellows sealing gasket, not shown.

Drive means, not shown, are provided for driving the inner drum 12 in opposite directions of rotation during the washing phase and in a single direction at higher speed for causing dewatering by use of the spin-drying effect. A good dewatering carried out in this way is crucial for keeping the drying times down during a subsequent drying process.

Moreover, the machine is provided with water supply means 20 comprising a solenoid valve 22 and conveying water to a container 24 for detergents and rinsing agents. From the container 24 the water is conveyed, where appropriate together with detergents or rinsing agents, via a conduit 26 to the outer container 10 therein forming washing and rinsing liquid, respectively. After the completion of a a washing or a rinsing phase the outer container 10 has to be drained and for this purpose an outlet conduit 28 is provided which via a drainage pump 30 and a drainage conduit 32 conveys the water to a sewerage.

In addition to its function as a washing machine the combined machine has also a function as a tumble drier for the subsequent ready-drying of the washed and spin-dried textiles. For this purpose a circulation loop 34 is provided for a gaseous drying medium which, according to the invention, consists of dry superheated steam. The circulation loop 34 has an inlet 36 connected to the front gable 38 of the outer drum 10 and an outlet 40 correspondingly connected to the rear gable 42 of the outer drum 10. The circulation loop includes a fan 44 driven by an electric motor, not shown. Moreover, a heating arrangement for the drying medium is included, preferably an electric heating element 46.

For diverting part of the drying medium flowing through the circulation loop a conduit 48 is provided which leads to a compressor 50. Via a conduit 52, the outlet of the compressor 50 is connected to a condenser 54 disposed so that during the condensing of the moisture-saturated drying medium diverted from the circulation loop, which by compressing has obtained a greatly increased temperature, the released heat is returned to the drying medium in the circulation loop before the drying medium is again conveyed into the inner drum 12. The condensed water from the condenser 54 is conveyed via a conduit 56 to a condensate container 58. For the control of the washing and drying processes in the combined machine program control means 60 are provided which with the use of the technique of today can be computer-based.

The combined machine shown in the drawing operates in the following manner. The total process, including a washing phase and a drying phase, starts with the preparations for the washing phase by the insertion of articles of laundry into the inner drum 12 and by the insertion of detergents and rinsing agents in the container 24. Then, in the usual way, an appropriate program is selected and the washing phase is started. Normally, this phase is ended by a spin-drying phase giving a suitable residual moisture in the laundry. In case of a good spin-drying effect a residual moisture level of 60–70% can be expected. This will give the shortest, most optimal drying time during the subsequent ready-drying of the laundry. Taking into consideration that certain kinds of textile cannot stand heavy spin-drying, for those articles of clothing one have to accept a higher level of residual moisture with the resulting longer drying time.

When the washing phase has been completed by spin-drying the drying process follows immediately. Now, the water supply means 20 are inactive as well as the drainage pump 30. The drying process begins with the starting of the fan 44 causing an air flow to be driven in the circulation loop 34 in the direction illustrated by arrows in the drawing. Initially, the heating element 46 is activated so as to heat the circulating air which heats the laundry in the inner drum 12. In the usual way, the drum is rotated during the drying phase either in one single direction or alternatingly in opposite directions. Gradually as the laundry is heated moisture is given off to the circulating air which, as time goes on, becomes more and more moisture-saturated. During this initial stage one can see to it that air can be discharged to the environment so that, finally, the circulating drying medium essentially will consist of wet steam.

When it has been determined that the drying medium mainly consists of wet steam part of it is diverted via conduit 48 to the compressor 50 which compresses the steam so that the temperature increases to about 200° C. This superheated steam is conducted via conduit 52 to the condenser 54 where it is cooled and gives off its heat to the circulating steam in the circulation loop. As appears from the drawing, this is achieved by the condenser 54 with the inlet 36 of the circulation loop 34 forming a heat exchanger. During the condensation of the steam of a temperature of about 200° C. the wet steam flowing in the circulation loop 34 will be gradually heated to become superheated. During the major part of the drying phase the drying will then take place at a temperature of about 100° C. and with a drying medium flow mainly comprised of superheated dry steam. The drying phase is discontinued either after an appropriate time or after detection of the fact that the dry steam in conduit 48 no longer absorbs moisture from the laundry in the inner drum 12.

As a result of the superheated steam having a temperature of about 200° C. when reaching the condenser 54, in addition to its soft water condition, the condensed water will also retain part of the heat energy which opens for additional energy savings due to the fact that the water, already heated, can be used in subsequent washing phases. When arriving at the condensate container 58 the water has a temperature of close to 100° C. and in order to extend the time the water can be kept heated the condensate container 58 can be made insulated.

During a drying phase it can be expected that about five liters of water be obtained per hour, dependent on the residual moisture of the laundry. Should there be a need for greater amounts of clean water for use in subsequent washing phases it would be possible to use the compressor 50 for steam generation also separate from the drying process. The advantage associated hereto is that, for example, directly before a washing phase an appropriate amount of clean water can be generated having a temperature of about 100° C. Then, this water can be mixed with an appropriate amount of previously generated clean water of a lower temperature to form a suitable amount of wash liquid of a desired temperature adapted to the washing process. Then, due to the desire of generating clean de-ionized water the heating of the wash liquid will take place without additional energy contributions.

For the purpose indicated the heat exchanger 54 can be provided with valves 62, 64 closing the connection between the heat exchanger and the circulation loop 34. Moreover, the portion of the heat exchanger thus separated can be connected to the suction side of the compressor 50 by means of a separate conduit 68 provided with a valve 66. Generally, then a small amount of water can be supplied to the part of the heat exchanger normally connected in the circulation loop 34, said water being appropriately heated to evaporation temperature. For example, for this purpose heating element 46 can be used. When the steam generation in the heat exchanger has been initiated the compressor 50 is started in order to suck and compress the generated steam which is then, via conduit 52, returned to the heat exchanger 54 for condensing and transfer of heat to the opposite side of the heat exchanger. When the evaporation process has been initiated, via a suitable additional valve, not shown, additional water can be sprayed into the heat exchanger for generating a desired amount of clean water. It is also thinkable that a separate condenser be provided for the water generation described.

A more detailed description of the components required for the reuse of condensed water will not be give as it would be obvious for the man skilled in the art how to generally provide such arrangement.

What is claimed is:

1. A combined machine for washing and drying textiles, comprising a wash liquor tub (10) which contains an inner drum (12) rotatably provided and supporting the textiles during the washing and drying processes and having a volume adapted to requirements relating to the wash process, water supply means (20) for supplying water into the tub (10), water draining means (28,30,32) for draining washing and rinsing liquid from the tub (10), and means (44) for driving a moisture absorbing gaseous medium in a closed loop (34) past the textiles in the inner drum (12), characterized in that the moisture absorbing gaseous medium consists of dry superheated steam, diverting means (48) being provided to divert part of the steam flowing in the closed loop (34), compressor means (50) being provided to compress the steam diverted from the closed loop (34), and heat exchanger means (54) provided to condense the compressed steam and return the heat released during the condensing process to the steam in the closed loop (34).

2. Machine according to claim 1, characterized in that the water discharged during the condensing process is collected in a condensate container (58) for further use in subsequent washing processes.

3. Machine according to claim 1 or claim 2, characterized in that heating means (46) are provided during an initial stage to cause heating of the air circulating through the inner drum (12) and gradually being saturated with moisture given off by the textiles.

4. Machine according to claim 3, characterized in that the heating means (46) consists of an electric heating element.

5. Machine according to claim 1, characterized in that the compressor means (50) are adapted to be activated first upon the temperature of the air/steam-mixture circulating in the inner drum (12) reaching about 100° C.

6. Method for washing and drying textiles in a treatment chamber (12), wherein the textiles are first treated in a conventional water washing process, dewatered by means of spin-drying and then dried by means of dry superheated steam circulated in a closed loop (34) past the textiles, characterized in that part of the steam in the circulation loop (34) is diverted and heated by being compressed to a temperature exceeding 100° C., the steam thus superheated being led to a heat exchanger (54) to be condensed, said heat exchanger (54) being adapted to transfer the heat released during the condensing process to the steam in the circulation loop (34) for heating of the same.

7. Method according to claim 6, characterized in that the condensate generated in the heat exchanger (54) is collected for generating a supply of clean water intended to be used in subsequent washing processes.

8. Method according to claim 7, characterized in that prior to a washing phase the heat exchanger (54) and the compressor (50) are activated for generating an amount of clean water at a temperature of about 100° C. which by being mixed with previously generated clean water of lower temperature forms an amount of wash liquid of a suitable temperature required by the washing process.

9. Method according to claim 7 or claim 8, characterized in that the side of the heat exchanger (54) connected to the circulation loop (34) is separated therefrom and connected to the suction side of the compressor (50), water being introduced in the part of the heat exchanger (54) thus separated.

10. Method according to claim 9, characterized in that in order to initiate the water generating process a small amount of water is first supplied and heated to evaporation temperature after which the compressor (50) is started for compressing the steam and the compressed steam is led to the opposite side of the heat exchanger (54) to be condensed, the released heat being returned to the separated side of the heat exchanger (54).

* * * * *